US006000972A

United States Patent [19]

Abe

[11] Patent Number: 6,000,972

[45] Date of Patent: Dec. 14, 1999

[54] STRUCTURE FOR FIXING TERMINAL TO CONNECTOR HOUSING

[75] Inventor: Kimihiro Abe, Shizuoka, Japan

[73] Assignee: Yazaki Corporation, Tokyo, Japan

[21] Appl. No.: 08/997,059

[22] Filed: Dec. 23, 1997

[30] Foreign Application Priority Data

Dec. 26, 1996 [JP] Japan ..... 8-348101

[51] Int. Cl.[6] ..... H01R 13/40

[52] U.S. Cl. ..... 439/733.1; 439/752

[58] Field of Search ..... 439/733.1, 752, 439/595, 752.5

[56] References Cited

U.S. PATENT DOCUMENTS 5,181,862 1/1993 Hawk et al. ..... 439/752

5,478,263 12/1995 Kato ..... 439/752

5,683,272 11/1997 Abe ..... 439/752.5

FOREIGN PATENT DOCUMENTS 2-299176 12/1990 Japan .

*Primary Examiner*—Michael L. Gellner

*Assistant Examiner*—Briggitte R. Hammond

*Attorney, Agent, or Firm*—Morgan, Lewis & Bockius LLP

[57] ABSTRACT

A terminal includes a stabilizer with an embossing portion. A connector housing includes a terminal accommodating chamber. On an inner wall of the terminal accommodating chamber, there is provided a stabilizer inserting groove into which the stabilizer is inserted. In the stabilizer inserting groove, there is provided an embossing engaging portion with which the embossing portion is engaged when the terminal is inserted into the terminal accommodating chamber.

11 Claims, 6 Drawing Sheets

STRUCTURE FOR FIXING TERMINAL TO CONNECTOR HOUSING

BACKGROUND OF THE INVENTION

1. Field of the Invention

This invention relates to a structure for fixing a terminal to a connector housing in which the terminal is fixed into a terminal accommodating chamber formed on the connector housing.

2. Background

FIG. 7 is a view showing a terminal 1 described in Unexamined Japanese Patent Publication No. Hei. 2-299176, and FIGS. 8*a*, 8*b* and 8*c* are views showing a connector housing 2 in which a terminal accommodating chamber 8 accommodating the terminal 1 is formed.

The terminal 1 is formed in such a manner that a sheet member is punched in a developed condition and bent into the shape of the terminal 1 shown in FIG. 7. The terminal 1 includes a contact section 3 for mating with a mate terminal on one side thereof, and a wire connecting section 4 for connecting with an end portion of an electric wire on the other side thereof. The contact section 3 has a pair of resilient pieces 5, 5 which are opposed to each other. When a mate terminal is inserted between these resilient pieces 5, 5, the terminal 1 is electrically connected with a mate terminal. The wire connecting section 4 has a pair of pressure blades 6, 6 formed by bending both side walls. When an end portion of the electric wire is press connected between the pressure blades 6, 6, the end portion of the electric wire and the terminal 1 are electrically connected with each other. Furthermore, an engaging piece 7 is formed between the contact section 3 and the wire connecting section 4, such that the engaging piece 7 is cut out and raised upwardly. The engaging piece 7 is engaged with a terminal release hole 11 formed in the inner wall of the terminal accommodating chamber 8, so that the terminal 1 cannot separate from the terminal accommodating chamber 8 while the terminal 1 is accommodated in the connector housing 2.

As shown in FIGS. 8*a*, 8*b* and 8*c*, the terminal accommodating chamber 8 includes an opening 9 formed in one side thereof, and an opening 10 formed in the other side thereof. The opening 9 allows an insertion of a mate terminal into the terminal accommodating chamber 8. The opening 10 allows an insertion of the terminal 1 into the terminal accommodating chamber 8.

The terminal release hole 11 is formed in an upper wall of the connector housing 2 to communicate the terminal accommodating chamber 8 with the outside. The engaging piece 7 of the terminal 1 is engaged with an opening edge portion of the terminal release hole 11 inside the accommodating chamber 8.

As shown in FIG. 8*a*, when the terminal 1 is inserted from the opening 10 into the terminal accommodating chamber 8 until the front end portions of the resilient pieces 5, 5 are positioned at the side of the connector housing 2 with opening, the engaging piece 7 is engaged with the terminal release hole 11. Accordingly, the terminal 1 is completely accommodated in the terminal accommodating chamber 8 so as to prevent the terminal 1 from coming off from the terminal accommodating chamber 8.

On the other hand, the terminal 1 can be drawn out from the terminal accommodating chamber 8 by use of a tool for drawing the terminal 1. Specifically, the tool is inserted into the terminal release hole 11 and the engaging piece 7 is pushed by the tool so that the engaging piece 7 can be disengaged from the terminal release hole 11. Accordingly, the terminal 1 can be drawn out from the terminal accommodating chamber 8.

In this case, if the terminal release hole 11 is provided on a surface (engaging surface) on which the opening 9 is formed, there is a possibility that the tool is mistakenly inserted through the opening 9 into the terminal accommodating chamber 8. In addition, the contact section 3 of the terminal 1 may be damaged. In order to solve the aforementioned problems, the terminal release hole 11 is provided perpendicularly to the opening 9 of the terminal accommodating chamber 8 in the upper surface of the connector housing 2. According to the this arrangement, it is possible to prevent damage of the terminal 1.

However, in the case where the terminal release hole 11 is formed in the upper surface of the connector housing 2, the following problems may be encountered. Since the terminal release hole 11 is located in an under-cut portion with respect to a metal mold drawing direction (shown by arrow "a" in FIGS. 8*a*–8*c* in order to mold the connector housing 2, it is necessary to provide a sliding metal mold capable of moving in a direction perpendicular to the metal mold drawing direction in order to mold the connector housing 2 with the terminal release hole 11 in the upper surface. As a result, the structure of the metal mold to form the connector housing 2 may become complicated, and the number of parts of the sliding mechanism for the sliding metal mold will increase thereby increasing the parts cost. Accordingly, the manufacturing cost of the connector housing 2 is increased.

In addition, since the engaging piece 7, which engages with the opening edge portion of the terminal release hole 11, is formed by cutting and raising the portion of the contact section to be resilient the engaging piece 7 may be deformed when an excessively high intensity of drawing force is applied to the engaging piece 7. Furthermore, when the engagement of the engaging piece 7 with the terminal release hole 11 is released by the tool, the engaging piece 7 may be plastically deformed if an excessively high intensity of force is applied to the engaging piece 7. Therefore, in the structure of the terminal 1, the engaging piece 7 prevents the terminal 1 from coming off from the terminal accommodating chamber 8 and is susceptible to damage when an excessively high intensity of force is applied.

SUMMARY OF THE INVENTION

It is an object of the present invention to provide a structure for fixing a terminal to a connector housing, in which the connector housing is formed by a metal mold of simple structure so that the parts cost can be reduced. It is difficult to deform the terminal even if an excessively high intensity of force is applied to it.

The above objective has been achieved by a structure for fixing a terminal to a connector housing comprising the terminal including a contact section arranged on one side of the terminal with which an opponent terminal is contacted and also having a wire connecting section arranged on the other side of the terminal with which an electric wire end is connected. The connector housing includes a terminal accommodating chamber, both sides of which have openings, into which the terminal is fixed. A stabilizer is arranged protruding from the terminal and an embossing portion is formed in the stabilizer. A stabilizer inserting groove section into which the stabilizer is inserted is formed on an inner wall of the terminal accommodating chamber of the connector housing in a direction which coincides with a metal mold drawing direction in the case of forming the connector housing; and an embossing engaging portion with which the embossing portion is engaged is formed in the stabilizer inserting groove section.

In this structure for fixing a terminal to a connector housing, the terminal is inserted into one opening of the terminal accommodating chamber, and the stabilizer of the terminal is inserted into the stabilizer inserting groove section of the connector housing. Then, the embossing portion of the stabilizer is engaged with the embossing engaging portion of the stabilizer inserting groove section. Due to the foregoing, the terminal can be accommodated in the terminal accommodating chamber under the condition that the terminal is prevented from coming off from the terminal accommodating chamber.

In this structure for fixing a terminal to a connector housing, when the stabilizer inserting groove section is arranged in a direction of drawing the metal mold used for forming the connector housing, the metal mold can be drawn out only in one direction. As a result, it is unnecessary to use a sliding die.

The stabilizer of the terminal in the above structure is only inserted into the stabilizer inserting groove section. Accordingly, even when an excessively high intensity of force is applied to the terminal in a direction of drawing out the terminal, it is difficult for the stabilizer to be deformed.

Since the stabilizer is provided with the embossing portion, the mechanical strength of the stabilizer is enhanced. Further when the embossing portion is engaged with the embossing engaging portion, it is possible to maintain the same mechanical strength of preventing the terminal from coming off of the terminal.

In the structure for fixing a terminal to a connector housing, the stabilizer may have a sheet-shaped projection arranged between the contact section and the wire connecting section of the terminal. Further, the embossing portion has a protrusion whose cross-section may be formed into an arc shape. The protrusion is arranged in the sheet-shaped projection. Furthermore, the stabilizer inserting groove section is formed in a direction of the insertion of the terminal into the terminal accommodating chamber, and the embossing engaging portion has a recess whose cross-section may be formed into an arc shape. The recess is arranged on one of the inner walls of the stabilizer inserting groove section.

According to this structure, when the terminal is inserted into the terminal accommodating chamber, the stabilizer is inserted into the stabilizer inserting groove section, and the embossing portion, the cross-section of which is formed into an arc shape, is engaged with the embossing engaging portion, the cross-section of which is formed into an arc shape. When the embossing portion is engaged with the embossing engaging portion, the terminal can be prevented from coming off from the terminal accommodating chamber.

In the structure for fixing a terminal to a connector housing, the stabilizer inserting groove section is opened onto the inserting side of the terminal into the terminal accommodating chamber, and a stabilizer picking inclined surface to guide the stabilizer into the stabilizer inserting groove section is formed at an opening edge section of the stabilizer inserting groove section.

According to this structure, when the terminal is inserted into the terminal accommodating chamber, the stabilizer slides on the stabilizer picking inclined surface and is guided into the stabilizer inserting groove section.

In the structure for fixing a terminal to a connector housing, the stabilizer is arranged on one side of the terminal, and the stabilizer inserting groove section is arranged on one side of terminal accommodating chamber in the width direction.

According to this structure, the stabilizer inserting groove section is arranged on one side of the terminal accommodating chamber in the width direction. Therefore, when the stabilizer is inserted into the stabilizer inserting groove section, the terminal is accommodated in the terminal accommodating chamber under the condition that the terminal is pushed onto the inner wall on one side of the terminal accommodating chamber.

BRIEF DESCRIPTION OF THE DRAWINGS

FIGS. 8*a*, 8*b* and 8*c* are views showing a conventional connector housing in which the conventional terminal shown in FIG. 7 is accommodated, in which FIG. 8*a* is a cross-sectional view showing a state before the terminal is inserted into the connector housing, FIG. 8*b* is a cross-sectional view showing a state in which the terminal is inserted into an intermediate portion of the terminal accommodating chamber, and FIG. 8*c* is a cross-sectional view showing a state in which the terminal is completely inserted into the terminal accommodating chamber.

DETAILED DESCRIPTION OF THE PREFERRED EMBODIMENTS

An embodiment of the structure for fixing a terminal to a connector housing of the present invention will be explained as follows.

Figure 1:
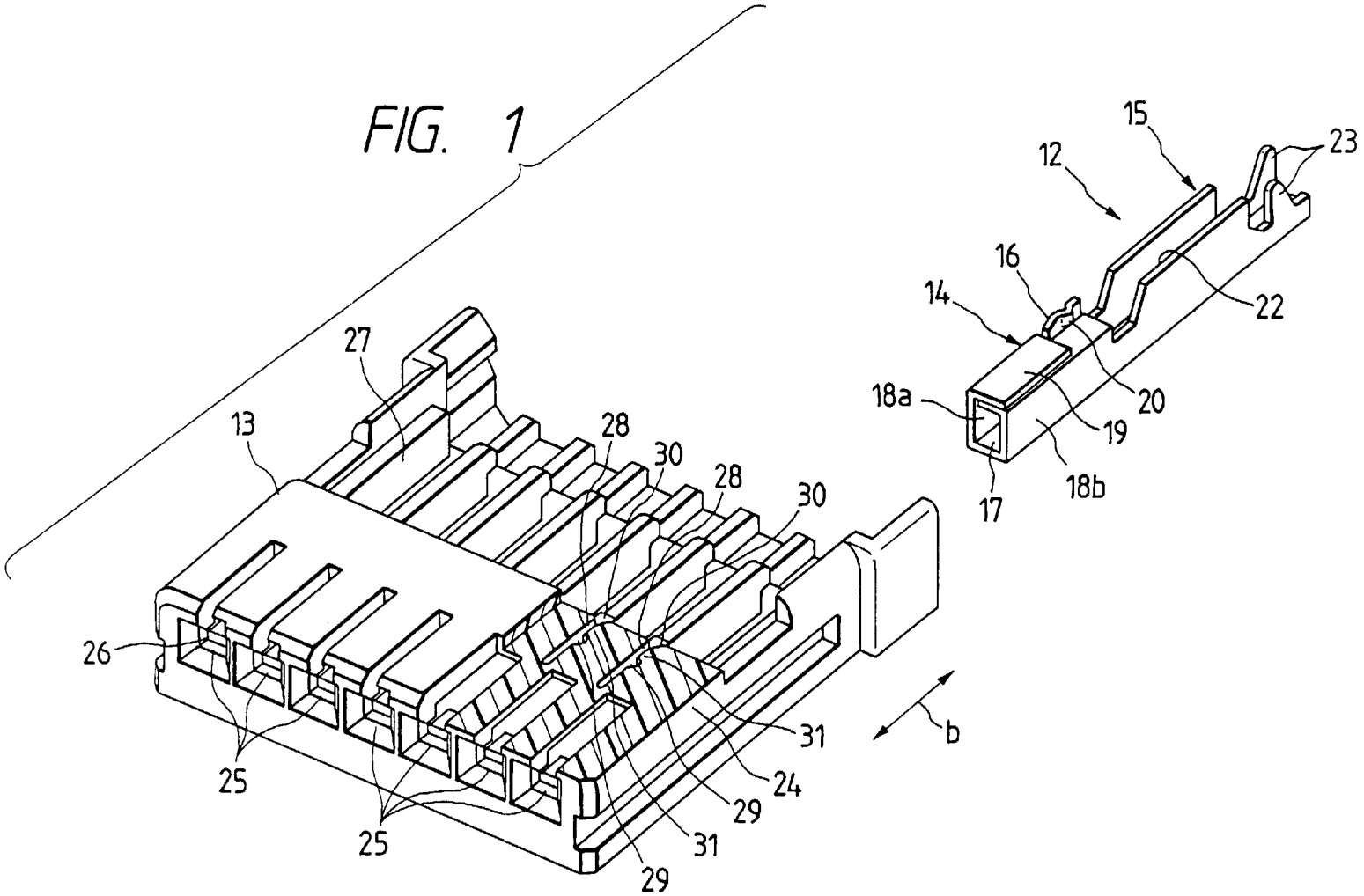
FIG. 1 is a perspective view showing a terminal to which the structure for fixing a terminal to a connector housing of the present invention is applied and also showing a connector housing in which the terminal is accommodated.
Figure 2A:
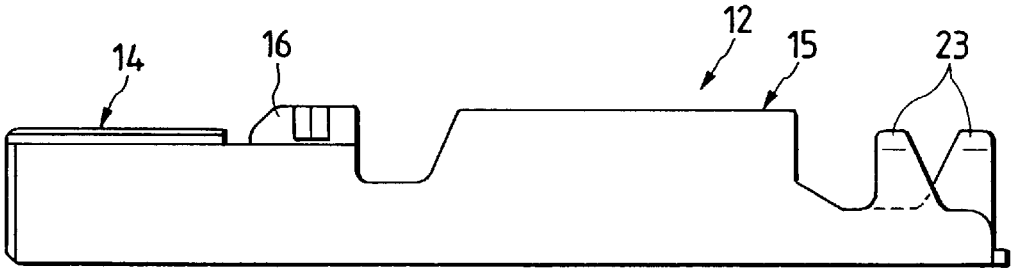
FIG. 2*a* is a side view of a terminal to which the present invention is applied.
Figure 2B:
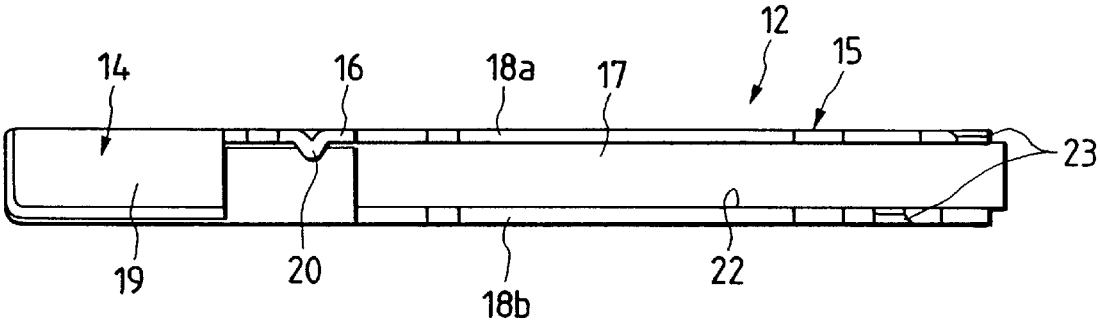
FIG. 2*b* is a plan view of the terminal.
Figure 3:
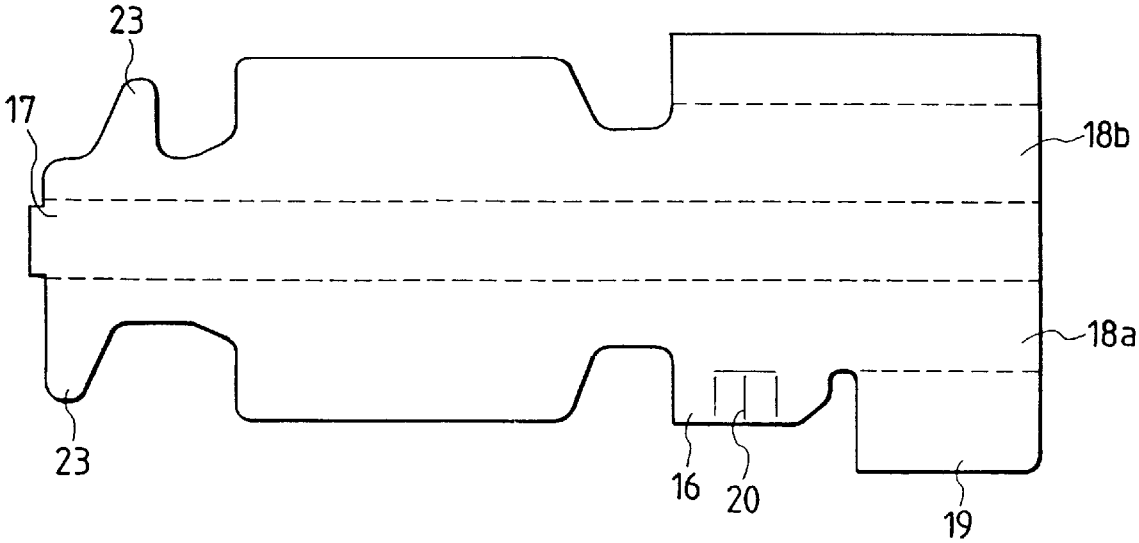
FIG. 3 is a plan view of an unfolded terminal to which the present invention is applied.
Figure 4:
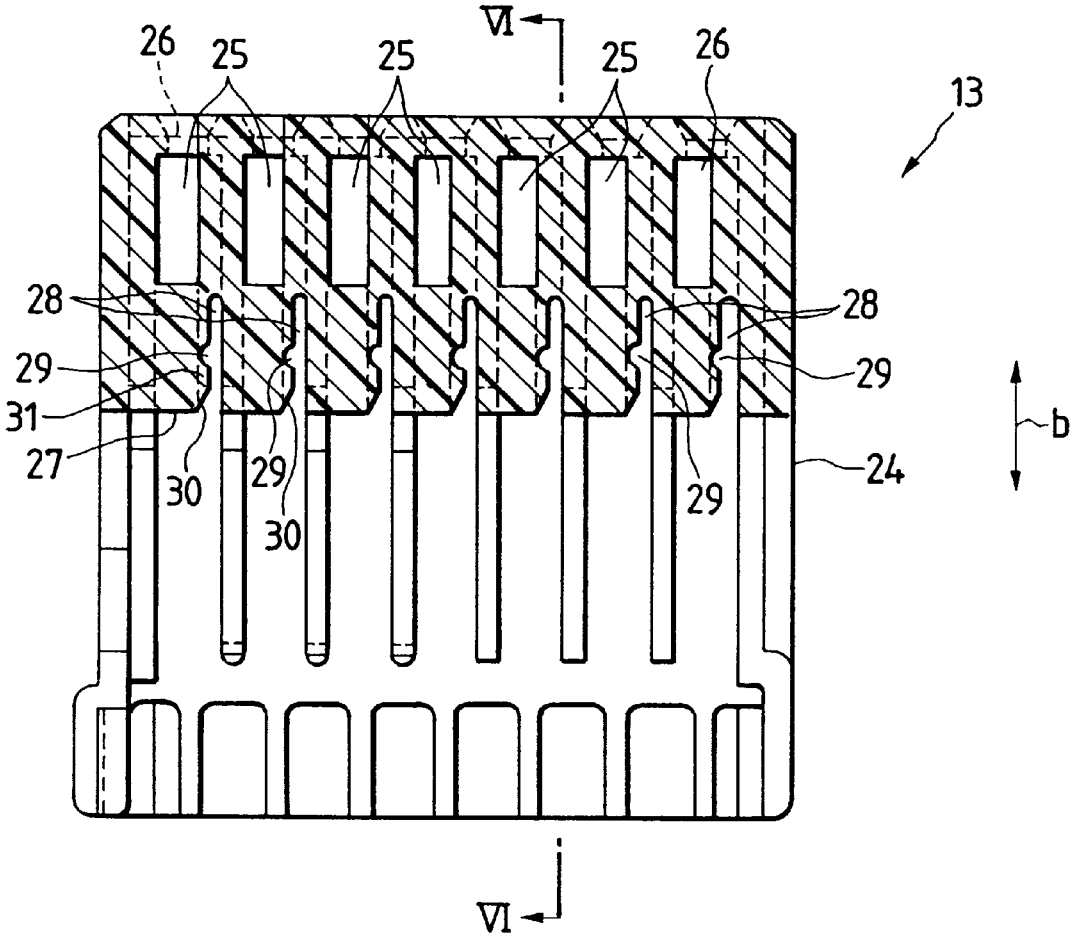
FIG. 4 is a cross-sectional view of a connector housing to which the present invention is applied taken on line IV—IV in FIG. 5.
Figure 5:
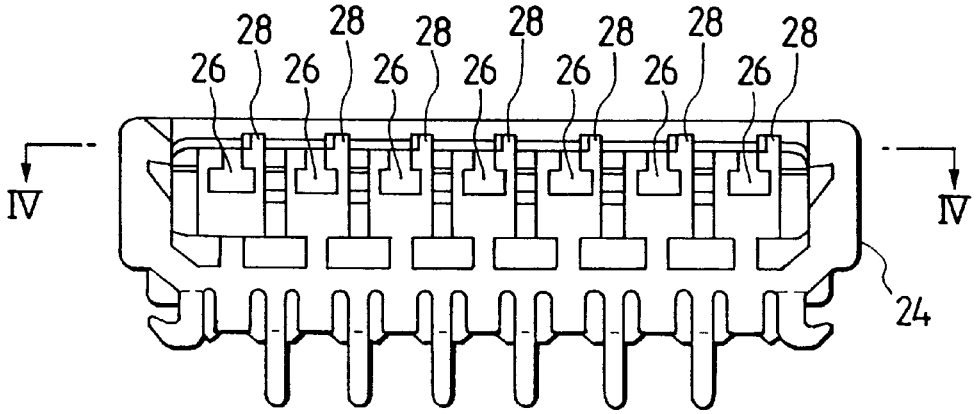
FIG. 5 is a rear view of a connector housing to which the present invention is applied.

FIG. 1 is a partially exploded perspective view showing a terminal 12 to which the present invention is applied and a connector housing 13 in which the terminal 12 is accommodated. FIG. 2*a* is a side view of the terminal 12, and FIG. 2*b* is a plan view. FIG. 3 showns the terminal 12 before it is bent. FIG. 4 is a cross-sectional plan view showing a connector housing 13, and FIG. 5 is a rear view also showing the connector housing 13.

As shown in FIGS. 2*a* and 2*b*, the terminal 12 includes a contact section 14 for mating with a mate terminal on one side thereof, and a wire connecting section 15 for connecting with an end portion of an electric wire on the other side thereof. A stabilizer 16 is formed between the contact section 14 and the wire connecting section 15 so as to project from the terminal 12.

As shown in FIGS. 2*a* and 2*b*, the contact section 14 is formed by a bottom plate 17, a pair of side plates 18*a*, 18*b* bent to extend in the same direction from both sides of the bottom plate 17, and an upper plate 19 extended from one of the side plates 18*a*, 18*b* and bent in such a manner that the upper plate 19 is opposed to the bottom plate 17. Thus, a cross-section of the contact section 14 is formed into a rectangular shape.

Further, the stabilizer 16 extends from the side plate 18*a*.

The stabilizer 16 is not bent with respect to the side plate 18*a* as shown in FIGS. 2*a* and 2*b*. When the contact section 14 is formed into a rectangular cross-section by the pair of side plates 18*a*, 18*b*, the bottom plate 17 and the upper plate 19, the stabilizer 16 projects upward from the side plate 18*a* of the contact section 14 as shown in FIG. 2*a*, and is formed into a sheet-shaped protrusion. The stabilizer 16 has an embossing portion 20 in an intermediate portion thereof. As shown in FIG. 2*b*, the embossing portion 20 projects toward the contact section 14. Further, the embossing portion 20 extends in the vertical direction of the terminal 12.

On the other hand, the wire connecting section 15 has a wire accommodating section 22 in which an electric wire end is accommodated, and a pair of clamping pieces 23, 23 on the rear end side of the wire accommodating section 22. Front end portions of these clamping pieces 23, 23 are formed with an acute angle. Therefore, the terminal 12 and an electric wire can be electrically connected with each other by the clamping pieces 23, 23 clamping the electric wire set on the bottom plate 17 and biting a sheath of the electric wire.

On the other hand, the connector housing 13 that is receivable the terminal 12, includes a plurality of terminal accommodating chambers 25 which are arranged in parallel with each other in the main body 24 of the connector housing 13 as shown in FIGS. 1 and 4. On one side of the terminal accommodating chamber 25, there is provided an opening 26 into which a mate terminal of a mate connector housing engaged with the connector housing 13 is inserted. On the other side of the terminal accommodating chamber 25, there is provided an opening 27, and an upper portion and a rear end portion of the opening 27 are opened. As shown in FIG. 4, the terminal 12 is inserted into the opening 27, and the terminal 12 is accommodated in the terminal accommodating chamber 25 at a position where an end surface of the contact section 14 comes into contact with an inner peripheral edge of the opening 26.

Furthermore, the connector housing 13 includes a stabilizer inserting groove section 28 on the upside of the inner wall of the terminal accommodating chamber 25. The stabilizer inserting groove section 28 is formed in the terminal accommodating chamber 25 so as to extend in the inserting direction of the terminal 12 into the terminal accommodating chamber 25, and is opened to the side of the opening 27. The stabilizer inserting groove section 28 has an embossing engaging portion 29 a section of which is formed into an arc shape in one of the inner walls of the stabilizer inserting groove section 28. The embossing engaging portion 29 will be referred as a recess 29 hereinafter. The width of the stabilizer inserting groove section 28 is slightly larger than the thickness of the plate of the stabilizer 16 arranged in the terminal 12. Depth of the recess 29 is determined to be substantially the same as the projecting height of the embossing portion 20 of the stabilizer 16. Furthermore, a stabilizer picking inclined surface 30 is formed at an entrance of the stabilizer inserting groove section 28 of the opening 27 side so as to widely open the entrance.

In accordance with the above construction, when the terminal 12 is inserted into the terminal accommodating chamber 25, the stabilizer 16 is inserted from the opening 27 into the stabilizer inserting groove section 28, and then the embossing portion 20 abuts on a wall 31 located at a front side of the recess 29. When the stabilizer 16 is further inserted into the stabilizer inserting groove section 28, the embossing portion 20 is moved beyond the wall 31 and is inserted into and engaged with the recess 29. Accordingly, the terminal 12 is accommodated in the terminal accommodating chamber 25 so that the terminal 12 is prevented from coming off from the terminal accommodating chamber 25. Consequently, a surface of the wall 31 on the recess 29 side defines the embossing engaging portion for engaging the embossing portion 20.

The above connector housing 13 including the stabilizer inserting groove section 28 formed in the main body 24 is molded such that the metal mold drawing direction coincides with the direction of terminal insertion in which the terminal 12 is inserted into the terminal accommodating chamber 25. Namely, the metal mold drawing direction coincides with the direction of an arrow "b" shown in FIGS. 1 and 4. In the case where the longitudinal direction of the connector housing 13 is the metal mold drawing direction, the wall 31 on the opening 27 side, in which the recess 29 of the stabilizer inserting groove section 28 is formed, becomes an undercut portion. In this case, the metal mold for forming the recess 29 is drawn so that the cross-section of the recess 29 is an arc shape after the formation of the connector housing 13. Accordingly, it is possible to form the connector housing 13 only when the metal mold is drawn in the longitudinal direction.

Next, the procedure by which the terminal 12 is accommodated in the terminal accommodating chamber 25 is explained.

Figure 6A:
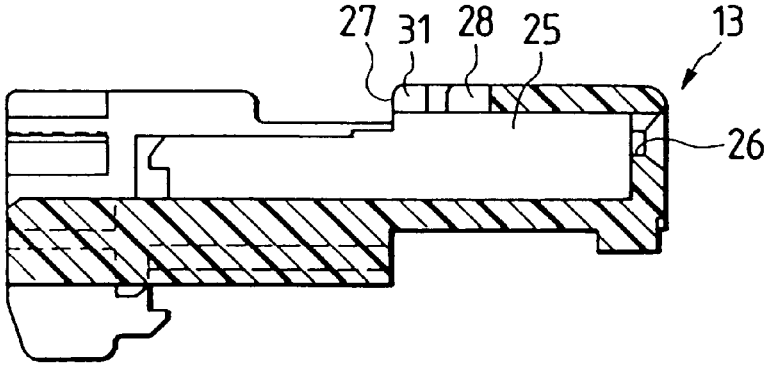
FIG. 6*a* is a cross-sectional view of the inside of a connector housing to which the present invention is applied, in which the view is taken on line VI—VI in FIG. 4.
Figure 6B:
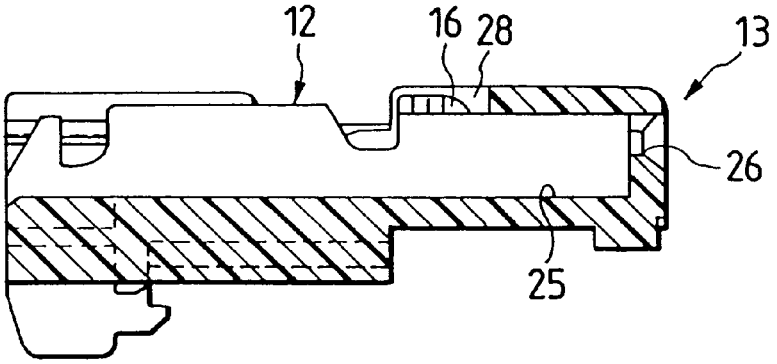
FIG. 6*b* is a cross-sectional view showing a state in which the terminal is accommodated in the terminal accommodating chamber and FIG. 6*c* is an enlarged plan view showing the engagement of the stabilizer and the engaging portion.
Figure 6C:
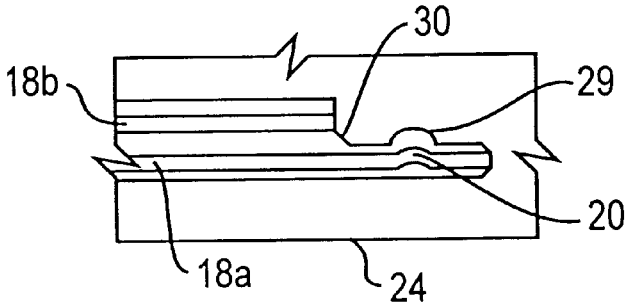
Figure 7:
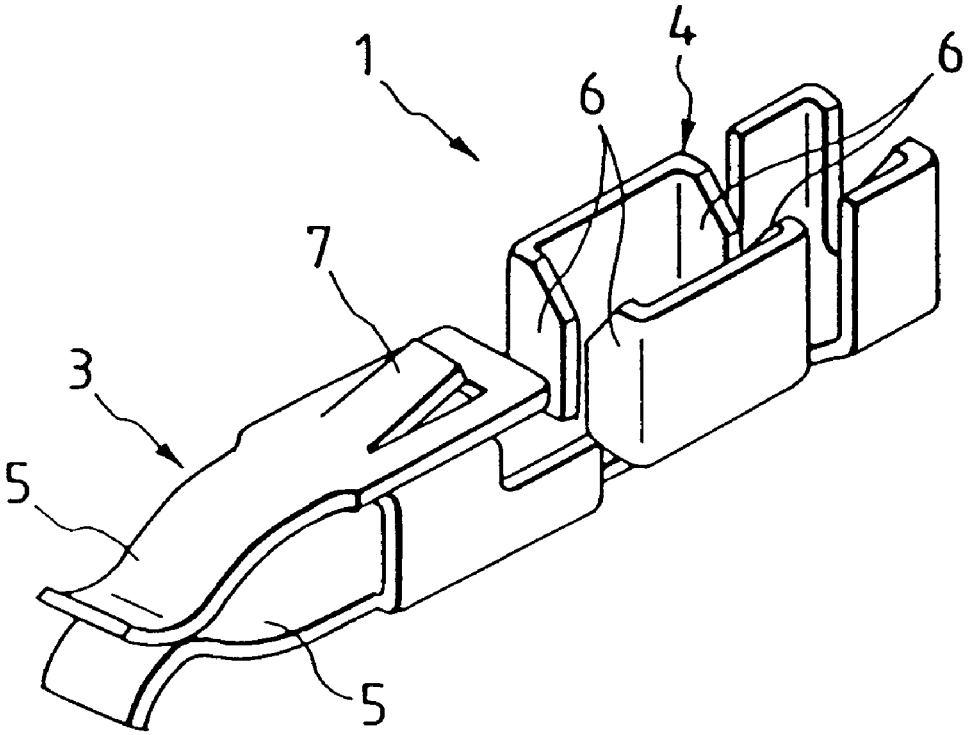
FIG. 7 PRIOR ART
FIG. 7 is a perspective view of a conventional terminal.
Figure 8A:
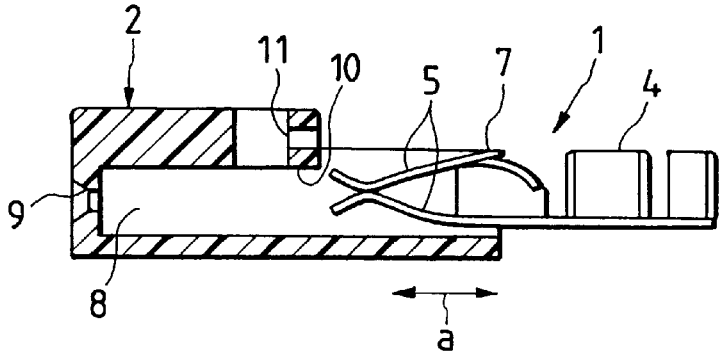
FIG. 8a PRIOR ART
Figure 8B:
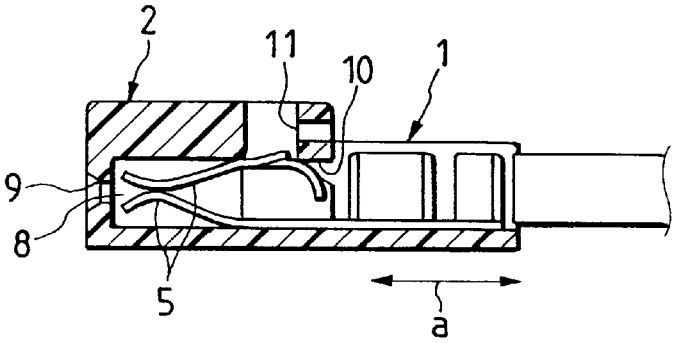
FIG. 8b PRIOR ART
Figure 8C:
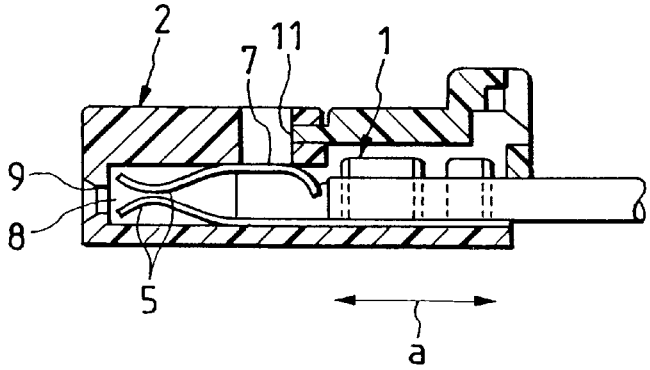
FIG. 8c PRIOR ART

The terminal 12 is inserted from the opening 27 side into the terminal accommodating chamber 25 until the front end surface of the contact section 14 comes into contact with the inner peripheral edge of the opening 26. At this time, the stabilizer 16 of the terminal 12 is automatically inserted into the stabilizer inserting groove section 28. When the terminal 12 is pushed into the terminal accommodating chamber 25, the embossing portion 20 of the stabilizer 16 abuts on the wall 31 of the stabilizer inserting groove section 28 on the opening 27 side. When the terminal 12 is further pushed into the terminal accommodating chamber 25, the embossing portion 20 moves beyond the wall 31 and is inserted into and engaged with the recess 29 as shown in FIG. 6*c*. In this case, the wall 31 is somewhat deformed, however, after the embossing portion 20 has passed along the wall 31, the deformed shape returns to the initial state. When the embossing portion 20 is inserted into and engaged with the recess 29, the terminal 12 is prevented from coming off from the terminal accommodating chamber 25.

According to the structure for fixing a terminal to a connector housing of this embodiment, the stabilizer inserting groove section 28 is formed in the connector housing 13 in the metal mold drawing direction. Therefore, the metal mold to form the connector housing 13 may be drawn out only in one direction. As a result of the above structure, it is unnecessary to use a sliding die, that is, the parts cost can be reduced by using only a metal mold of simple structure.

In the above structure, the stabilizer 16 of the terminal 12 is only inserted into the stabilizer inserting groove section 28. Accordingly, even if an unnecessarily high intensity of force is applied to the stabilizer 16 in the terminal drawing direction, it is difficult for the stabilizer to be deformed. Therefore, when the terminal is pulled out from the terminal accommodating chamber, the terminal is not deformed even if it is strongly pulled in the terminal pulling direction.

Further, the embossing portion 20 is arranged in the stabilizer 16 so that the mechanical strength of the stabilizer 16 can be enhanced. Further, when the embossing portion is engaged with the embossing engaging portion, the mechanical strength to prevent the terminal from coming off can be maintained at the same value as that of the conventional terminal.

The stabilizer inserting groove section 28 is formed in such a manner that the width of the stabilizer inserting groove section 28 is slightly larger than the thickness of the stabilizer 16. Therefore, it is possible to press the stabilizer 16 onto one side of the terminal 12 and the terminal accommodating chamber 25. Accordingly, it is possible to prevent the terminal 12 from moving in the terminal accommodating chamber 25.

Further, the stabilizer picking inclined surface 30 is arranged at the opening edge of the stabilizer inserting groove section 28. Accordingly, even if some dimensional errors are caused, they can be absorbed by the stabilizer picking inclined surface 30. Accordingly, since the stabilizer is formed on the terminal, it is not necessary to provide a high dimensional accuracy. Therefore, the manufacturing cost can be reduced.

Furthermore, when the terminal is inserted into the terminal accommodating chamber, the stabilizer slides on a stabilizer picking inclined surface and is guided into the stabilizer inserting groove section. Therefore, the stabilizer can be easily inserted into the stabilizer inserting groove section. Accordingly, some dimensional errors can be absorbed.

When the terminal 12 is drawn out from the terminal accommodating chamber 25 in this embodiment, the embossing portion 20 can move over the wall 31 only by strongly pulling the terminal 12 toward the rear end side. At this time, it is unnecessary to use a specific tool for drawing out the terminal. Accordingly, there is no possibility of damaging the contact section 14 by the tool for drawing out the terminal 12.

What is claimed is:

1. A connector device for fixing a terminal to a connector housing, comprising:

a terminal including:

a wire connecting section to which an electric wire is connected;

a contact section matable with another terminal; and a stabilizer formed between the wire connecting section and the contact section to project from the terminal, the stabilizer having an embossing portion projected therefrom, and a cross-section of the embossing portion being formed into an arc shape; and a connecter housing including:

a terminal accommodating chamber for receiving the terminal; and a stabilizer inserting groove receiving the stabilizer when the terminal is inserted into the terminal accommodating chamber, the stabilizer inserting groove being formed in an inner wall of the terminal accommodating chamber to extend in the same direction in which the terminal is inserted into the terminal accommodating chamber, and the stabilizer inserting groove having an embossing engaging portion, wherein when the terminal is inserted into the terminal accommodating chamber, the embossing engaging portion is engaged with the embossing portion, the embossing engaging portion has a recess having an arc shape, and the embossing engaging portion is arranged on one of the inner walls of the stabilizer inserting groove.

2. The connector device of claim 1, wherein the direction in which the terminal is inserted into the terminal accommodating chamber coincides with a direction in which a mold used to form the connector housing would be drawn.

3. The connector device of claim 1, wherein the stabilizer inserting groove opens toward a side of the connector housing into which the terminal is inserted, and the stabilizer inserting groove has an inclined surface guiding the stabilizer into the stabilizer inserting groove, the inclined surface is formed on an opened edge portion of the stabilizer inserting groove.

4. The connector device of claim 1, wherein the stabilizer inserting groove opens toward a side of the connector housing into which the terminal is inserted, and the stabilizer inserting groove has an inclined surface guiding the stabilizer into the stabilizer inserting groove, the inclined surface is formed on an opened edge portion of the stabilizer inserting groove.

5. The connector device of claim 1, wherein the stabilizer is arranged on one side of the terminal, and the stabilizer inserting groove is arranged on one side of the terminal accommodating chamber in a width direction.

6. A connector device for fixing a terminal to a connector housing, comprising:

a terminal including:

a wire connecting section to which an electric wire is connected, the wire connecting section being formed on one side of the terminal;

a contact section matable with another terminal, the contact section being formed on the other side of the terminal;

a stabilizer arranged to project from the terminal; and an embossing portion formed in the stabilizer, a cross-section of the embossing portion being formed into an arc shape; and a connecter housing including:

a terminal accommodating chamber into which the terminal is insertable, both sides of the terminal accommodating chamber are open;

a stabilizer inserting groove, into which the stabilizer is insertable, being formed on an inner wall of the terminal accommodating chamber in a direction which coincides with a direction in which a mold used to form the connector housing is drawn; and an embossing engaging portion, with which the embossing engaging portion is engaged, formed in the stabilizer inserting groove, wherein the embossing engaging portion has a recess whose cross-section is formed into an arc shape.

7. The connector device of claim 6, wherein the stabilizer is a sheet-shaped projection arranged between the contact section and the wire connecting section, the protrusion is arranged in the sheet-shaped projection, the stabilizer inserting groove is formed in the same direction in which the terminal is inserted into the terminal accommodating chamber, and the recess is arranged on one of the inner walls of the stabilizer inserting groove.

8. The connector device of claim 6, wherein the stabilizer inserting groove opens toward a side of the connector housing into which the terminal is inserted, and the stabilizer inserting groove has an inclined surface guiding the stabilizer into the stabilizer inserting groove, the inclined surface is formed on an opened edge portion of the stabilizer inserting groove.

9. The connector device of claim 6, wherein the stabilizer is arranged on one side of the terminal, and the stabilizer inserting groove is arranged on one side of the terminal accommodating chamber in a width direction.

10. A connector device comprising:

a terminal including:

a first end to which an electric wire can be connected;

a second end; and a stabilizer located between the first and second ends, the stabilizer projecting from the terminal and having an embossing portion projecting therefrom, a cross-section of the embossing portion being formed into an arc shape; and a connector housing including:

a chamber for receiving the terminal; and a portion defining a groove for receiving the stabilizer when the terminal is inserted into the chamber, wherein the groove has an engaging portion, the embossing portion engages the engaging portion when the terminal is inserted into the chamber the engaging portion has a recess having an arc shape and the embossing portion engages the recess when the terminal is inserted into the chamber.

11. The connector device of claim 10, wherein the groove opens toward a side of the connector housing into which the terminal is inserted, the groove has an inclined surface guiding the stabilizer into the groove, and the inclined surface is formed on an opened edge portion of the groove.

* * * * *